United States Patent [19]

Nutting

[11] Patent Number: 4,891,869

[45] Date of Patent: Jan. 9, 1990

[54] CARDBOARD COFFIN AND METHOD FOR FORMING THE SAME

[76] Inventor: Donald W. Nutting, 1295 Ithaca Dr., Boulder, Colo. 80303

[21] Appl. No.: 220,529

[22] Filed: Jul. 18, 1988

[51] Int. Cl.[4] ..... A63G 17/00

[52] U.S. Cl. ..... 27/4; 229/23 R

[58] Field of Search ..... 27/2, 4, 5, 6, 7, 19, 27/35, 27; 229/23 R, 52 A, 125.08, 125.29

[56] References Cited

U.S. PATENT DOCUMENTS

| | | | |
|---|---|---|---|
| 3,969,798 | 7/1976 | Sahlin | 27/4 |
| 4,151,630 | 5/1979 | Havey | 27/2 |
| 4,156,956 | 6/1979 | Partridge et al. | 27/4 |
| 4,170,054 | 10/1979 | Buffner et al. | 27/4 |
| 4,339,596 | 8/1983 | Parlour et al. | 27/4 |

FOREIGN PATENT DOCUMENTS

| | | | |
|---|---|---|---|
| 2013739 | 10/1971 | Fed. Rep. of Germany | 27/4 |
| 531812 | 8/1955 | Italy | 27/4 |
| 7907743 | 4/1981 | Netherlands | 27/4 |
| 1183329 | 3/1970 | United Kingdom | 27/4 |

*Primary Examiner*—Richard E. Chilcot, Jr.
*Attorney, Agent, or Firm*—Klaas & Law

[57] ABSTRACT

A cardboard coffin for use at parties or similar occasions which is formed from a plurality of corrugated cardboard blanks having appropriate score lines formed therein to facilitate folding comprising a bottom having a central body portion having a perimeter in the shape of a coffin and defined by a plurality of score lines. A plurality of integral rectangularly shaped portions extend upwardly from the perimeter and have an angular relationship with the central body portions of about 90 degrees wall portions are formed from two cardboard blanks having score lines so that the two cardboard blanks may be folded along the score lines to form two opposite side wall portions and overlapping top and bottom wall portions which are secured together by tape. The integral rectangularly shaped portions of the bottom are secured to the adjacent surfaces of the wall portions by tape. If desired, a lid having a central body portion having a perimeter in the shape of a coffin defined by a plurality of score lines with a plurality of integral rectangularly shaped portions extending from the each of the score lines is provided. One of the integral rectangularly shaped portions is secured to a portion of one of the side walls to hingedly mount the lid for movement between closed and opened positions. All of the other integral rectangularly shaped portions are adapted to be folded upon themselves and be secured together so as to have an angular relationship with the central body portion of 90 degrees so that the wall portions may be received with the configuration defined by all of the other integral rectangularly shaped portions.

20 Claims, 4 Drawing Sheets

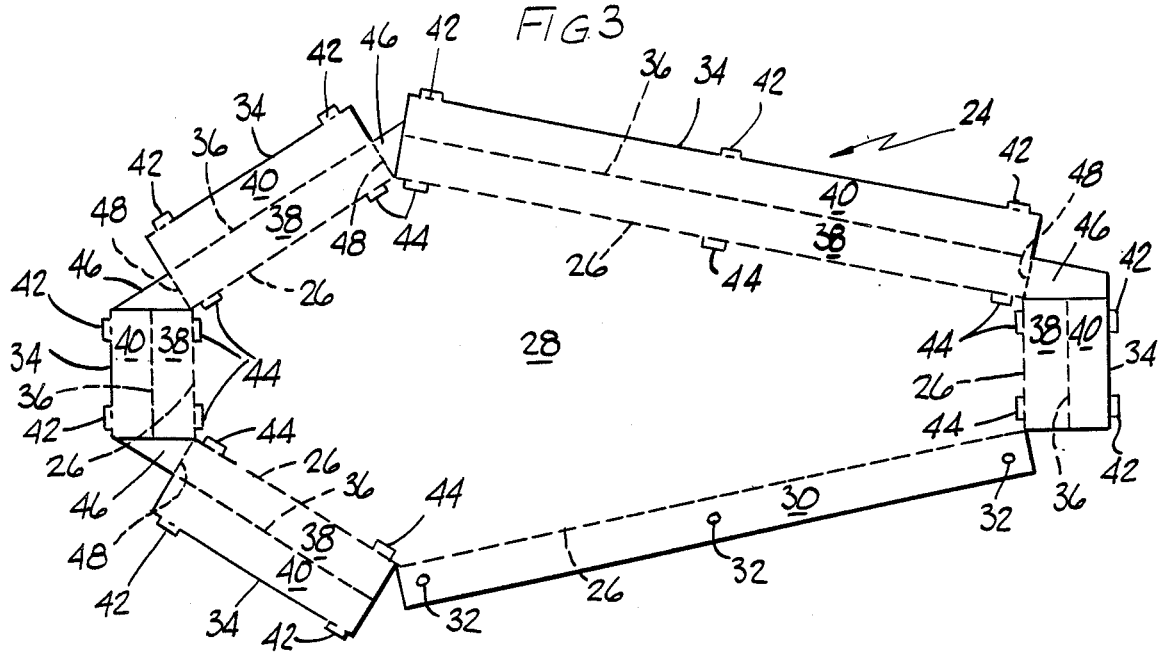
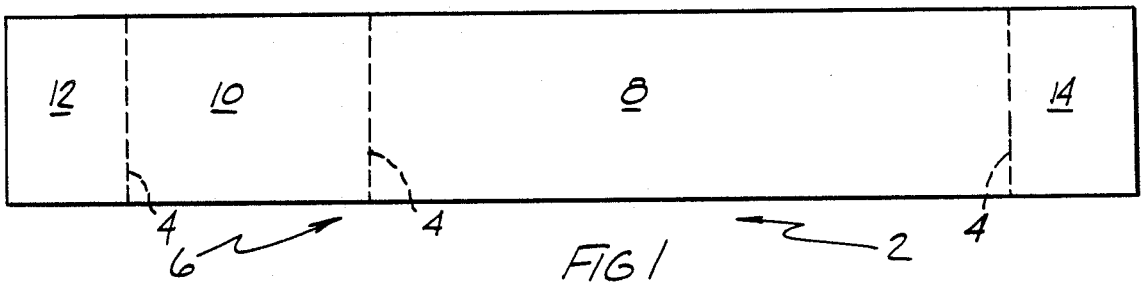
FIG 1
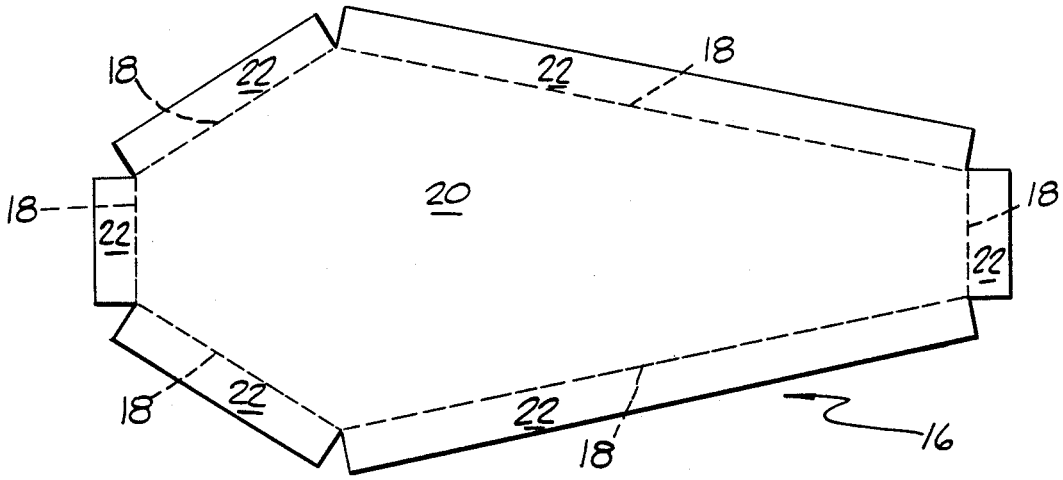
FIG 2

FIG. 6
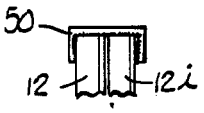
FIG. 4
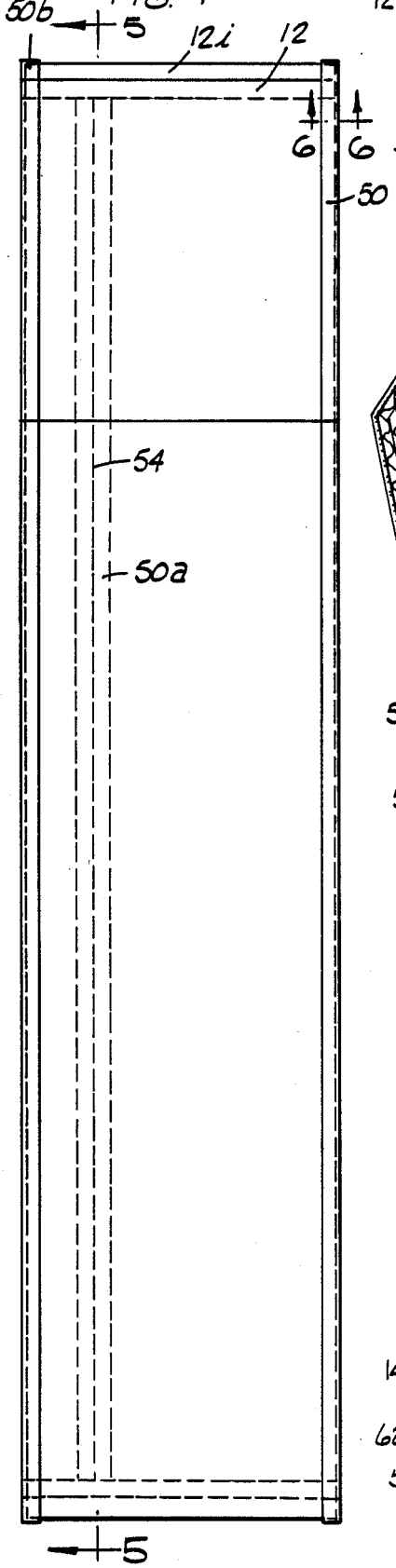
FIG. 5
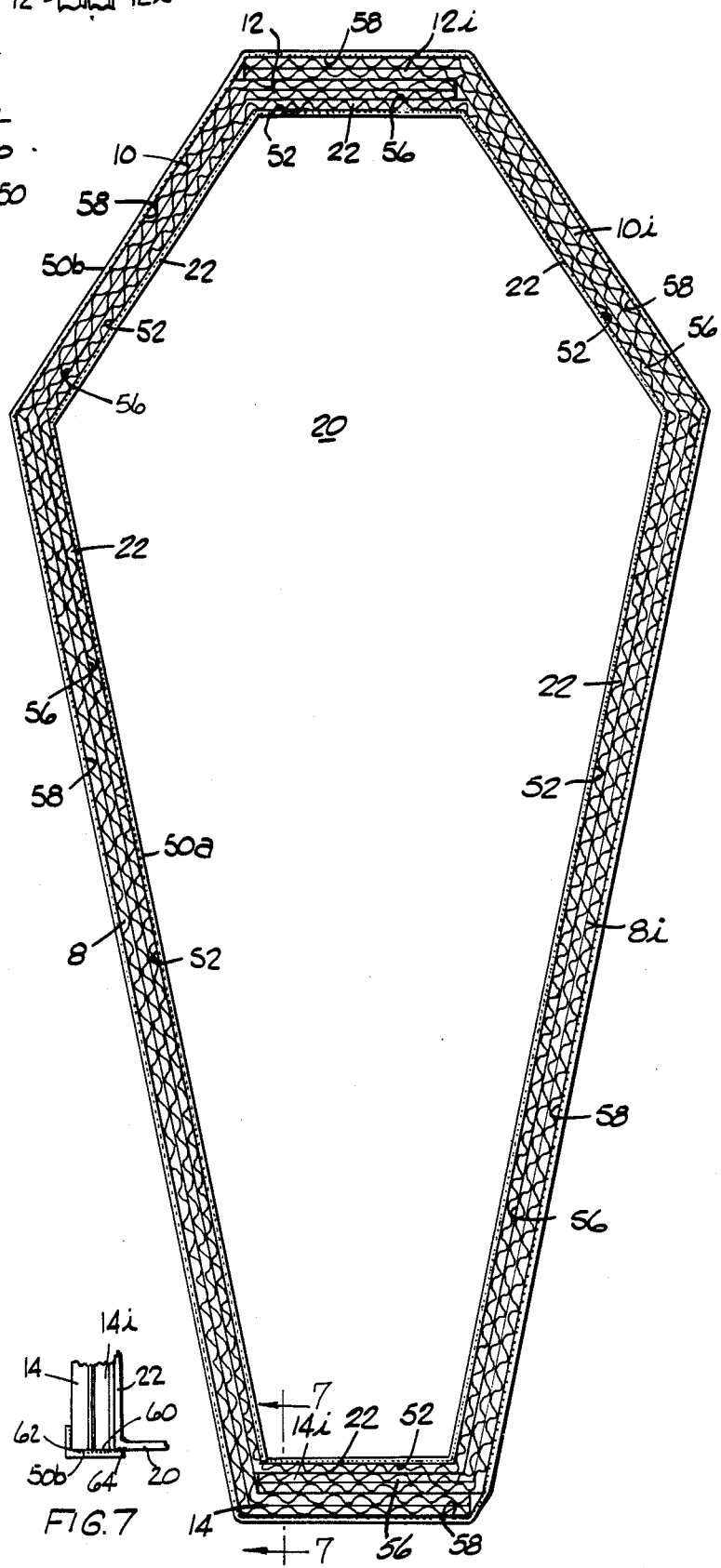
FIG. 7

46
42
38
40
42
40
38
42
46
42
38
40
42
46
42
38
40
42
46
42
38
40

CARDBOARD COFFIN AND METHOD FOR FORMING THE SAME

FIELD OF THE INVENTION

This invention relates generally to novelty products and methods for forming such novelty products for use at parties and conventions and more particularly to a cardboard coffin and methods for forming such cardboard coffin.

BACKGROUND OF THE INVENTION

It is common practice, particularly during the fall and winter seasons of the calendar year, to have masquerade parties where people dress in costumes which are often fantastic. At some of these parties, there is provided a coffin in which a person costumed as a vampire, monster or skeleton, will pretend to be dead and then arise from the dead at contemplated intervals with or without a lid. However, the use of a lid is more effective. Since the costs of an actual coffin are so high, imitation coffins have been marketed for use at such parties. Such imitation coffins have generally been still too expensive or of a construction which is not durable, too small and/or they do not have structures which permit the performance of many functions which the person masquerading as a vampire, master or skeleton, would like to perform. Therefore, there exists a need for a durable and functional imitation coffin for use at parties or conventions as described above. Without a lid, this designed coffin may be used more passively with only an inanimate body (or no body, impressive merely by the large size of the coffin).

BRIEF DESCRIPTION OF THE INVENTION

This invention provides a plurality of cardboard blanks which may be enclosed in a container with accessory items and instructions for forming a durable and functional cardboard coffin for use at parties or conventions. The assembled cardboard coffin has a length, width and depth that will readily accommodate an adult person. The coffin lid is hingedly mounted on one of the side walls of the coffin for pivotal movement about a first axis extending at an angular relationship to the longitudinal axis of the coffin.

In the preferred embodiment of the invention, the first and second cardboard blanks are used to form the walls of the coffin. The first and second cardboard blanks are identical in shape and construction. Each of the first and second cardboard blanks comprises a flat cardboard sheet formed from a double wall corrugated cardboard panel and has a generally rectangular shape having a length several times greater than its width. Each of the first and second cardboard blanks has a plurality of score lines extending widthwise across the blanks so that each of the first and second cardboard blanks may be folded about the score line to provide the side wall portions, the top wall portion and the bottom wall portion of the coffin. The third cardboard blank is used for forming the bottom of the coffin. The third cardboard blank comprises a flat cardboard sheet formed from a single wall corrugated cardboard panel having a central body portion in the shape of a coffin defined by a plurality of score lines. A plurality of integral rectangularly shaped portions extend outwardly from each of the score lines defining the central body portion. If it is desired to form a lid for the cardboard coffin, the fourth cardboard blank is used to form the lid. The fourth cardboard blank comprises a flat cardboard sheet formed from a single wall corrugated cardboard panel having a central body portion in the shape of a coffin defined by a plurality of score lines. A plurality of integral rectangularly shaped portions extend outwardly from each of the score lines defining the central body portion. All but one of the integral rectangularly shaped portions has an inner score line extending generally parallel to the score line from which it extends. Each of the all but one of the integral rectangularly shaped portions has a plurality of spaced apart tab portions extending radially outwardly therefrom. A plurality of spaced apart cut-outs are formed in the central body portion for cooperation with the spaced apart tab portions as described below. A roll of two inch wide black tape and three nuts and bolts are some of the accessory items.

The preferred method for assembling the cardboard blanks to form the cardboard coffin comprises folding the first and second cardboard blanks about their score lines and positioning them on a flat surface so that they extend upwardly therefrom and the portions of each of the first and second blanks forming the top wall portion of the coffin are moved into overlapping relationship and taped together. The portions of each of the first and second cardboard blanks forming the bottom wall portion of the coffin are moved into overlapping relationship and taped together. The third cardboard blank is laid on the flat surface. Each of the integral rectangularly shaped portions is successively folded around its score line until it extends perpendicularly from the central body portion. The third cardboard blank is then inserted into the combined first and second cardboard blanks and pushed downwardly until it contacts the flat surface. The integral rectangularly shaped portions of the third blank are then taped to adjoining portions of the inner surfaces of the first and second cardboard blanks. When a lid is to be provided, the fourth cardboard blank is laid on the flat surface and each of all but one of the integral rectangularly shaped blanks is folded around its internal score line and then each of the integral rectangularly shaped portions are folded about the score lines between them and the central body portion. During this folding, the tab portions are guided so that they enter the cut-outs in the central body portion of the lid. The folding is continued until the integral rectangularly shaped portions are perpendicular to the central body portion. Panel portions are provided to form a joint between adjacent ones of the folded integral rectangularly shaped portions. The folded fourth cardboard blank is then placed over the first and second cardboard blanks so that the first and second cardboard blanks are inside the folded fourth cardboard blank to form the lid for the coffin. The one of the integral rectangularly shaped portions is then secured to an adjoining portion of the first or second cardboard blank so that the folded fourth cardboard blank or lid may pivot around the score line between the secured integral rectangularly shaped portion and the central body portion between a closed and an opened position.

In a modification, the central body portion of the bottom is made larger so that when the integral rectangularly shaped portions are folded to extend upwardly therefrom at the angular relationship of 90 degrees, the assembled first and second cardboard blank will fit therein. The integral rectangularly shaped portions are then taped to adjoining portions of the outer surfaces of the first and second cardboard blanks.

BRIEF DESCRIPTION OF THE DRAWINGS

An illustrative and presently preferred embodiment of the invention is shown in the accompanying drawings in which:

FIG. 1 is a top plan view of a cardboard blank used in forming the wall portions of the coffin;

FIG. 2 is a top plan view of a cardboard blank used in forming the bottom of the coffin;

FIG. 3 is a top plan view of a cardboard blank used in forming the lid of a coffin;

FIG. 4 is a side elevational view of an assembled bottom and wall portions of the coffin without the lid;

FIG. 5 is a cross-sectional view taken on the line 5—5 of FIG. 4;

FIG. 6 is a partial cross-sectional view taken on the line 6—6 of FIG. 4;

FIG. 7 is a partial cross-sectional view taken on the line 7—7 of FIG. 5;

DETAILED DESCRIPTION OF THE INVENTION

Figure 8:
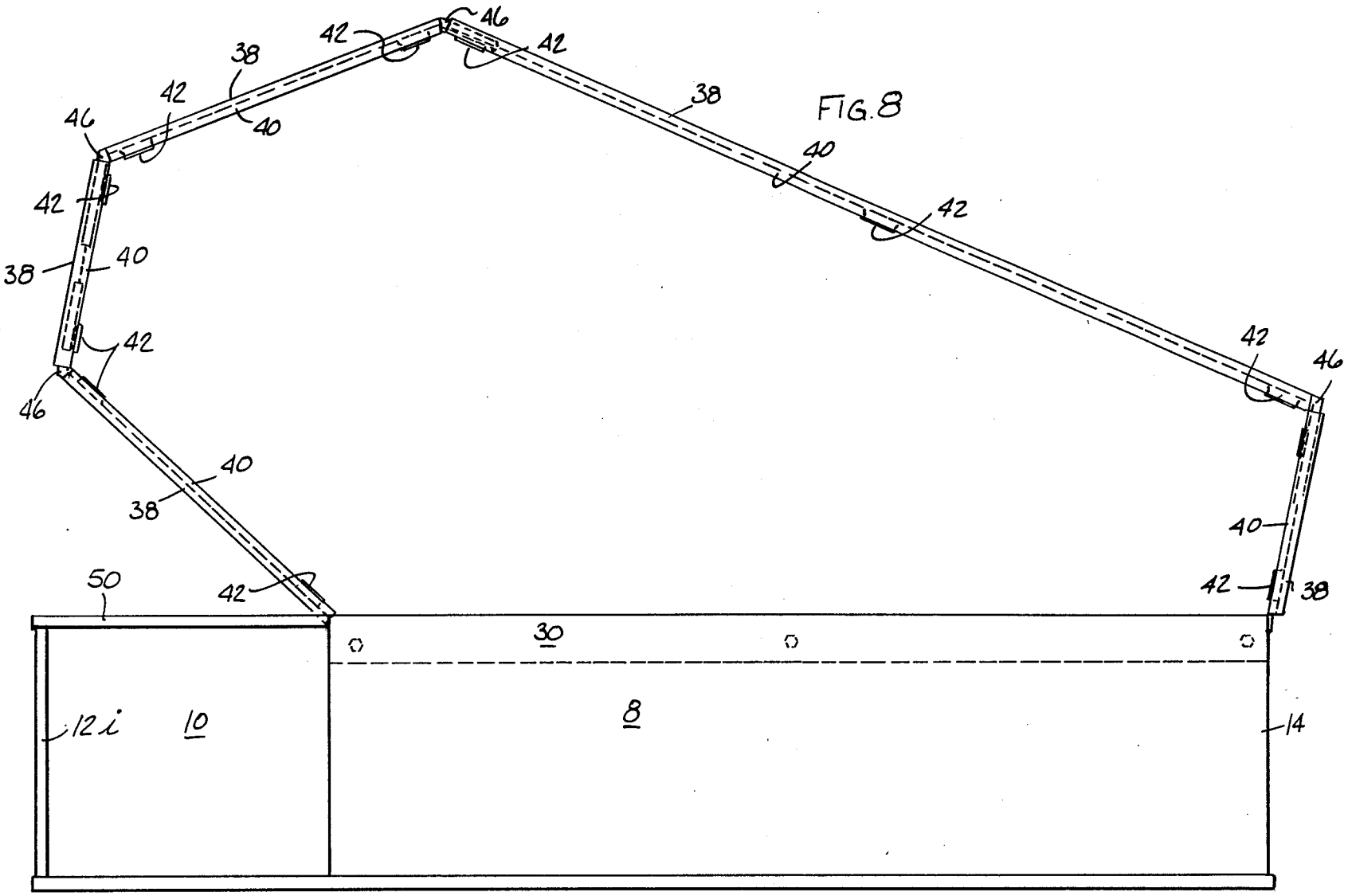
FIG. 8 is a side elevational view of the assembled coffin with the lid in an opened position.

In FIG. 1, there is illustrated a top plan view of a cardboard blank 2, two of which are used to form the wall portions of a cardboard coffin and are referred to in this application as the first and second cardboard blanks. The cardboard blank has a length many times greater than its width and is preferably formed from a double wall corrugated cardboard panel such as that marketed by Colorado Container Co. as having a thickness of 0.25 inch and a bursting strength of 275 pounds and is black in color. The cardboard blank 2 is provided with a plurality of score lines 4 extending in a widthwise direction. The score lines 4 permit the cardboard blank to be folded around the score lines 4 to form a side wall portion 6 comprising a relatively long section 8 and a relatively short section 10. Also formed are a top wall portion 12 and a bottom wall portion 14. The first and second cardboard blanks are assembled as described below.

In FIG. 2, there is illustrated a top plan view of a cardboard blank 16 used to form the bottom of the cardboard coffin and is referred to in this application as the third cardboard blank. The cardboard blank 16 is preferably formed from a single wall corrugated cardboard panel such as that marketed by Colorado Container Co. as having a thickness of 0.125 inch and a bursting strength of 200 pounds and is black in color. The cardboard blank 16 is provided with a plurality of score lines 18 which enclose and define a central body portion 20 having a perimeter defined by the score lines 18 in the shape of a coffin. A plurality of integral rectangularly shaped portions 22 extend outwardly from the score lines 18 and, as described below, are adapted to be folded around the score lines 18 and secured to the wall portions 6, the top wall portion 12 and the bottom wall portion 14.

In FIG. 3, there is illustrated a cardboard blank 24 used to form the lid of the cardboard coffin and is referred to in this application as the fourth cardboard blank. The cardboard blank 24 is preferably formed from a single wall corrugated cardboard panel such as that marketed by Colorado Container Co. as having a thickness of 0.125 inch and a bursting strength of 200 pounds and is black in color. The cardboard blank 24 is provided with a plurality of score lines 26 which enclose and define a central body portion 28 having a perimeter defined by the score lines 26 in the shape of a coffin. The cardboard blank 24 has a plurality of integral rectangularly shaped portions extending outwardly from the score lines 26. One integral rectangularly shaped portion 30 has a plurality of openings 32 extending therethrough and, as explained below, is adapted to be secured to one of the relatively long sections 8 of the side wall portion 6 so as to form a hinged connection to permit the lid to be moved between opened and closed positions. All of the other integral rectangularly shaped portions 34 extend outwardly from the score lines 26 and are provided with score lines 36 to divide each of the integral rectangularly shaped portions 34 into a first half-width portion 38 and a second half-width portion 40 so that they may be folded around the score lines 36 and moved into overlapping relationship. A plurality of integral spaced apart tabs 42 extend outwardly from the second-half width portions 40. In a modification, the integral rectangularly shaped portions 34 comprise only the first half-width portion 38 and the integral spaced apart tabs 42 extend outwardly from the first half-width portion 38. A plurality of spaced apart openings 44 extend through the central body portion 28 and, as explained below, are located so as to receive the tabs 42 to hold the first and second half-width portions 38 and 40 in the overlapping relationship. A plurality of panel portions 46 are integral with some of the first half-width portions 38 and are connected thereto by score lines 48 so that the panel portions 46 may be folded around the score lines 48 and, as explained below, be located between the overlapping first and second half-width portions 38 and 40 to hold adjacent first and second half-width portions 38 and 40 in a desired relationship. The panel portions 46 preferably are not secured to the next adjacent integral rectangularly shaped portion 34 but if desired may be secured thereto by a readily rupturable perforated line.

The assembled wall portions and bottom, comprising the top wall portion 12, the side wall portions 6, the bottom wall portion 14, the central body portion 20 and the integral rectangularly shaped portions 22 are illustrated in FIGS. 4 and 5 and are formed by first folding two of the cardboard panels 2 around the fold lines 4 to form the top wall sections 12, the relatively short sections 10, the relatively long sections 8 and the bottom wall sections 14. One of the folded cardboard blanks 2 is inverted and moved into the relationship illustrated in FIG. 5 wherein the top wall portions 12 are in an overlapping relationship on a flat surface (not shown) and the bottom wall portions 14 are in an overlapping relationship. In FIGS. 5–7, the reference numerals 8*i*, 10*i*, 12*i* and 14*i* represent the inverted cardboard blank 2. At this time, a tape 50 is applied over the top edges of the overlapped top wall portions 12 and 12*i*, the overlapped bottom wall portions 14 and 14*i*, the relatively short sections 10 and 10*i*, and the relatively long sections 8 and 8*i*. As illustrated in FIG. 6, the tape 50 functions to hold the overlapped top wall portions 12 and the overlapped bottom wall sections 14 secured together and to cover the exposed top edges of the top wall portions 12 and 12*i*, the bottom wall portions 14 and 14*i*, the relatively short sections 10 and 10*i*, and the relatively long sections 8 and 8*i*. A similar tape 50 may be used over the bottom edges.

The cardboard blank 16 is then placed on the flat surface and the integral rectangularly shaped portions 22 are folded around the fold lines 18 until they form an angular relationship with the central body portion 20 of about 90 degrees. The folded cardboard blank 16 is then inserted into the assembled cardboard blanks 2 and pushed downwardly until the central body portion 20 contacts the flat surface. A tape 50*a* is then applied to the inner surfaces 52 of the integral rectangularly shaped portions 22 and the tape 50*a* extends over the top edge 54 of the integral rectangularly shaped portions 22 and is secured to the adjacent portions of the inner surfaces 56 of the top wall portion 12, the relatively short sections 10 and 10*i*, the relatively long sections 8 and 8*i*, and the bottom wall portion 14*i*. A tape 50*b*, as illustrated in FIG. 7, is secured to the outer surfaces 58 of the top wall portion 12*i*, the relatively short sections 10 and 1O*i*, the relatively long sections 8 and 8*i*, and the bottom wall portion 14 and extends across the bottom edges 60 and 62 of these portions and is secured to the bottom surface 64 of the central body portion 20. The tape 50*b* functions to cover the bottom edges and to secure the central body portion 20 to the top wall portion 12*i*, the relatively short section 10 and 10*i*, the relatively long sections 8 and 8*i*, and the bottom wall portion 14.

When a lid is to be provided, the cardboard blank 24 is placed on the flat surface and all of the other integral rectangularly shaped portions 34 are folded about the fold lines 36 to put the first and second half-width portions 38 and 40 in overlapping relationship. During the folding operation, the panel portions 46 are placed between the cooperating first and second half-width portions 38 and 40, and the spaced apart tabs 42 are inserted into the openings 44. The panel portions 46 form a joint between adjacent folded integral rectangularly shaped portions 34 and the spaced apart tabs 42 in the opening 44 hold the first and second half-width portions 38 and 40 in the overlapping relationship. The inner configuration of the folded cardboard blank 24 is slightly larger than the outer configuration of the assembled top wall portions 12 and 12*i*, the relatively short sections 10 and 10*i*, the relatively long sections 8 and 8*i* and the bottom wall sections 14 and 14*i* so as to fit thereover and form a lid for the cardboard coffin.

The folded cardboard blank 24 is placed over the assembled top wall portions 12 and 12*i*, the relatively short sections 10 and 10*i*, the relatively long sections 8 and 8*i* and the bottom wall portions 14 and 14*i* and the one integral rectangularly shaped portion 30, as illustrated in FIG. 8, is folded around the score line 26 until it contacts the outer surface 58 of the relatively long section 8. The openings 32 in the integral rectangularly shaped portion 30 are then used to form aligned opening in the relatively long section 8 so that nuts (not shown) and bolts 31 may be used to secure the integral rectangularly shaped portion 30 to the relatively long section 8 so as to mount the lid or folded cardboard blank 24 on the relatively long section 8 for pivotal movement about the score line 26 between closed and opened positions. If desired, instead of the openings and nuts and bolts, the integral rectangularly shaped portion 30 may be secured to the relatively long section 8 by a tape similar to the tapes 50, 50*a* and 50*b* secured to adjacent portions of the outer surfaces of the integral rectangularly shaped portion 30 and the relatively long section 8. A handle 74 is secured to the central body portion 28 by tab portions 76 so that a person in the cardboard coffin can open and close the lid.

The tapes 50, 50*a* and 50*b* comprise black duct tape such as that marketed by Shuford Co. The use of the black duct tape as described above gives the cardboard coffin a solid appearance.

In the preferred embodiment of the invention, the cardboard coffin has an overall length of about 6.5 feet, a greatest width of about 3.0 feet, a shortest width of about 1.0 foot and an overall depth of about 1.5 feet. Each of the integral rectangularly shaped portions 22 and 30 and the first and second half-width portions 38 and 40 has a width of about 3.0 inches.

Figure 9:
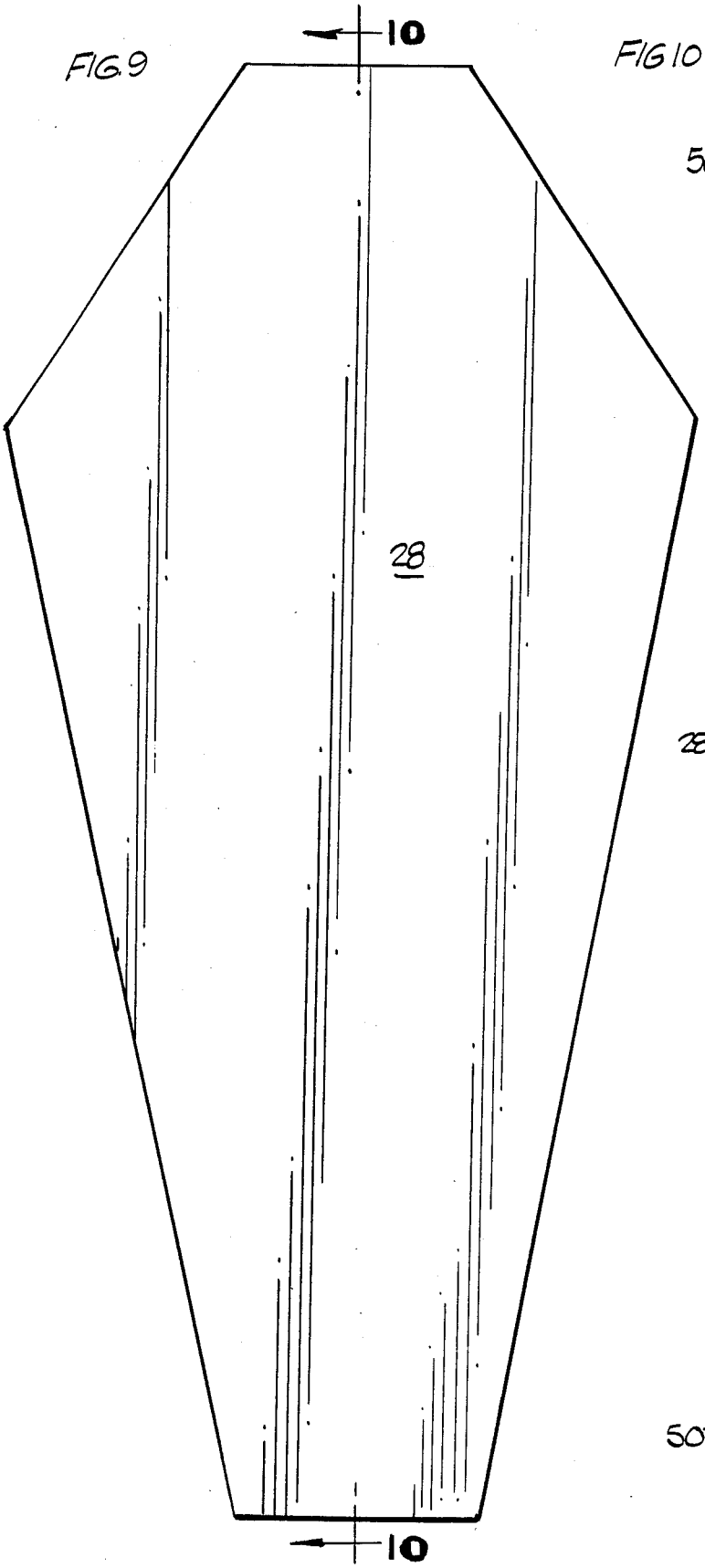
FIG. 9 is a top plan view of a modified cardboard coffin.
Figure 10:
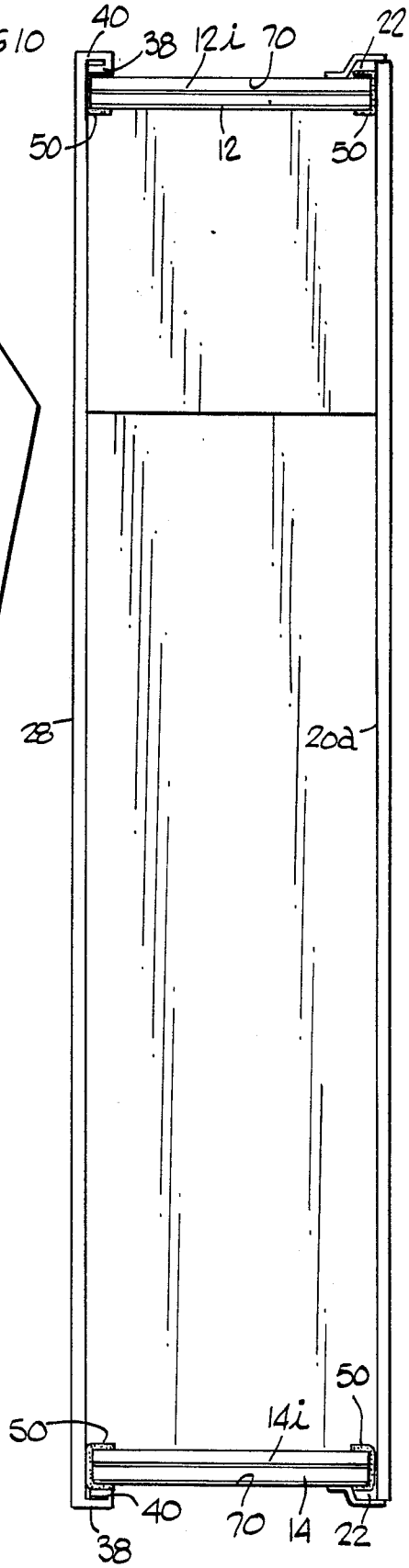
FIG. 10 is a cross-sectional view taken on the line 10—10 of FIG. 9.

A modification of the cardboard coffin is illustrate in FIGS. 9 and 10. In this modification, the central body portion 20*a* is made larger than the central body portion 20 of FIG. 2 so that the integral rectangularly shaped portions 22 are outside of the assembled first and second cardboard blanks 2. The tape 50*a* secures the integral rectangularly shaped portions to the outer surfaces 70 of the top wall portion 12*i*, the relatively short sections 10 and 10*i*, the relatively long sections 8 and 8*i* and the bottom wall portion 14.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A cardboard coffin formed from a plurality of separate cardboard blanks comprising:

first and second cardboard blanks for forming a pair of wall portions;

each of said wall portions comprising a top wall portion, a side wall portion and a bottom wall portion;

said top and bottom wall portions of said wall portions being in overlapping and contacting relationship;

securing means for securing said top and bottom wall portions in said overlapping relationship so that said wall portions have a transverse cross-sectional configuration wherein said top and bottom wall portions are in parallel relationship and said side wall portions comprise a pair of spaced apart relatively short inclined wall portions and a pair of spaced apart relatively long inclined wall portions;

a third cardboard blank for forming a bottom portions comprising a flat cardboard sheet having a central body portion having a perimeter defined by a plurality of score lines comprising a pair of spaced apart parallel score lines, a pair of spaced apart relatively short inclined score lines and a pair of spaced apart relatively long inclined score lines;

a plurality of integral rectangularly shaped portions extending upwardly from said perimeter of said central body portion with each of said integral rectangularly shaped portions having an angular relationship with said central body portion of about 90 degrees;

said central body portion having a length greater than its width and a lengthwise extending longitudinal axis;

said plurality of integral rectangularly shaped portions of said bottom portion being in juxtaposed relationship with portions of said wall portions; and securing means for securing said plurality of integral rectangularly shaped portions to adjacent portions of said wall portions.

2. A cardboard coffin as in claim 1 and further comprising:

a fourth cardboard blank for forming a lid for said cardboard coffin comprising a flat cardboard sheet having a central body portion having a perimeter defined by a plurality of score lines similar to said perimeter of said central body portion of said bottom portion;

a plurality of integral rectangularly shaped portions extending downwardly from said perimeter of said central body portion with each of said integral rectangularly shaped portions having an angular relationship with said central body portions of about 90 degrees;

said integral rectangularly shaped portions of said lid having an internal configuration permitting said integral rectangularly shaped portions to overlap portions of said wall portions; and mounting means for hingedly mounting one of said integral rectangularly shaped portions of said lid on at least a portion of one of said side wall portions so that said lid may be readily moved from a closed to an opened position.

3. A cardboard coffin as in claim 2 and further comprising:

a fold line in all but one of said integral rectangularly shaped portions of said lid extending in a direction generally parallel to an associated portion of said perimeter of said lid;

all of said integral rectangularly shaped portions except for said one of said integral rectangularly shaped portions being folded around said fold lines to form overlapping portions;

fastening means for holding each of said overlapping portions in said overlapping relationship; and holding means for holding together next adjacent ones of said all of said integral rectangularly shaped portions.

4. A coffin as in claim 3 wherein said fastening means comprises:

a plurality of spaced apart tab portions extending outwardly from each of said integral rectangularly shaped portions;

a plurality of spaced apart openings in said central body portion; and each of said tab portions being located in one of said openings.

5. A cardboard coffin as in claim 4 wherein said holding means comprises:

a plurality of panel portions integral with some of said all of one of said integral rectangularly shaped portions; and said panel portions being located between said overlapping portions of the next adjacent integral rectangularly shaped portions.

6. A cardboard coffin as in claim 4 wherein:

each of said side wall portions having a relatively long section extending generally in a lengthwise direction and a relatively short section extending generally in a lengthwise direction;

said relatively long and short sections having an acute angular relationship with said longitudinal axis of said cardboard container; and said lid is mounted on one of said relatively long sections.

7. A cardboard coffin as in claim 6 wherein said mounting means comprises:

a plurality of spaced apart holes extending through said one of said relatively long sections;

a plurality of spaced apart holes extending through said one of said integral rectangularly shaped portions of said lid; and headed threaded bolts extending through said holes in said one of said relatively long sections and said holes in said one of said rectangularly shaped portions of said lid and threaded nuts mounted on said headed threaded bolts.

8. A cardboard coffin as in claim 6 wherein:

said bottom portion and said lid are formed from a single wall corrugated cardboard panel; and said wall portions are formed from a double wall corrugated cardboard panel.

9. A cardboard coffin as in claim 2 wherein:

said bottom portion and said lid are formed from a single wall corrugated cardboard panel; and said wall portions are formed from a double wall corrugated cardboard panel.

10. A cardboard container as in claim 9 and further comprising:

covering means for covering all exposed end portions of said bottom portion, said wall portions and said lid;

said covering means comprising a black tape; and said bottom portion, said wall portions and said lid are black in color.

11. A cardboard coffin as in claim 1 and further comprising:

said wall portions have inner surfaces and outer surfaces; and said securing means securing said integral rectangularly shaped portions to said inner surfaces.

12. A cardboard coffin as in claim 11 and further comprising:

said central body portion of said bottom portion having a bottom surface;

said wall portions having bottom edges so that an open joint exists between said perimeter of said bottom surface and said bottom edge; and a tape secured to portions of said bottom surface and adjacent portions of said wall portions to cover said open joint and secure said central body portion to said wall portions.

13. A cardboard coffin as in claim 1 and further comprising:

said wall portions having inner surfaces and outer surfaces; and said securing means securing said integral rectangularly shaped portions of said bottom portion to said outer surfaces.

14. A cardboard coffin as in claim 1 wherein:

said secured together wall portions having inner and outer surfaces;

said plurality of integral rectangularly shaped portions of said bottom portion being secured to juxtaposed portions of said inner surface.

15. A cardboard coffin as in claim 14 and further comprising:

a fourth cardboard blank for forming a lid for said cardboard coffin comprising a flat cardboard sheet having a central body portion having a perimeter defined by a plurality of score lines similar to said perimeter of said central body portion of said bottom portion;

a plurality of integral rectangularly shaped portions extending downwardly from said perimeter of said central body portion with each of said integral rectangularly shaped portions having an angular relationship with said central body portion of about 90 degrees;

said integral rectangularly shaped portions of said lid having an internal configuration permitting said integral rectangularly shaped portions to overlap portions of said wall portions; and mounting means for hingedly mounting one of said integral rectangularly shaped portions of said lid on at least a portion of one of said side wall portions so that said lid may be readily moved from a closed to an opened position.

16. A cardboard coffin as in claim 15 and further comprising:

a fold line in all but one of said integral rectangularly shaped portions of said lid extending in a direction generally parallel to an associated portion of said perimeter of said lid;

all of said integral rectangularly shaped portions except for said one of said integral rectangularly shaped portions being folded around said fold lines to form overlapping portions;

fastening means for holding each of said overlapping portions in said overlapping relationship; and holding means for holding together next adjacent ones of said all of said integral rectangularly shaped portions.

17. A cardboard coffin as in claim 16 and further comprising:

covering means for covering all exposed end portions of said bottom portion, said wall portions and said lid;

said covering means comprising a black tape; and said bottom portion, said wall portions and said lid are black in color.

18. A method for forming a cardboard coffin using first and second cardboard blanks each of which comprises a flat corrugated cardboard sheet having a length several times greater than its width and having a plurality of score lines extending in a widthwise direction to provide side wall portions, top wall portions and bottom wall portions for said cardboard coffin; a third cardboard blank comprising a flat corrugated cardboard sheet having a central body portion in the shape of a coffin defined by a plurality of fold lines and a plurality of integral rectangularly shaped portions extending outwardly from each of said score lines; and a fourth cardboard blank comprising a flat corrugated cardboard sheet having a central body portion in the shape of a coffin defined by a plurality of score lines and a plurality of integral rectangularly shaped portions extending outwardly from each of said score lines and wherein all but one of the plurality of integral rectangularly shaped portions have a score line extending parallel to said score lines defining said central body portion comprising:

folding said first and second cardboard blanks around said fold lines to form a top wall portion, a side wall portion and a bottom wall portion;

placing said folded first and second cardboard blanks on a flat surface so that said fold lines extend vertically therefrom;

inverting said folded second cardboard blank and placing said folded second cardboard blank adjacent said folded first cardboard blank so that said top wall portions and said bottom wall portions thereof are in overlapping relationship;

securing together at least portions of the overlapping top wall portions and the overlapping bottom wall portions to form wall portions for said cardboard coffin having inner and outer surfaces;

folding said third cardboard blank about said score lines so that said integral rectangularly shaped portions have an angular relationship with said central body portion of about 90 degrees;

placing said folded third cardboard blank into a relationship with said wall portions so that said central body portion thereof contacts said flat surface and said integral rectangularly shaped portion are in overlapping relationship with juxtaposed portions of said top wall portions, said side wall portions and said bottom wall portions;

securing together juxtaposed portions of said integral rectangularly shaped portions and said top wall portions, said side wall portions and said bottom wall portion to form a bottom for cardboard coffin;

folding said all but one of said integral rectangularly shaped portions of said fourth cardboard blank about said score lines and securing them in said folded relationship wherein said folded all but one of said integral rectangularly shaped portions have an angular relationship with said central body portion of said fourth cardboard blank of about 90 degrees to form a lid for said coffin;

placing said lid over said wall portions so that said wall portions are located inside of said folded all but one of said integral rectangularly shaped portions;

folding said one integral rectangularly shaped portion about its score line until it contacts a portion of one of said side wall portions; and securing said one integral rectangularly shaped portion to said one of said side wall portions so that said lid may be pivoted between closed and opened positions.

19. A method as in claim 18 and further comprising:

placing said folded third cardboard blank inside said wall portions so that said integral rectangularly shaped portions are in overlapping relationship with juxtaposed portions of said inner surface.

20. A method as in claim 19 and further comprising:

covering all exposed portions of said folded first, second, third and fourth cardboard blanks using a tape to provide a solid appearance.

* * * * *